US010573172B2

(12) United States Patent
Vala

(10) Patent No.: US 10,573,172 B2
(45) Date of Patent: Feb. 25, 2020

(54) TRAFFIC SIGNAL DISPLAY AND METHOD

(71) Applicant: NVSVAV, LLC, Boca Raton, FL (US)

(72) Inventor: Nitin Vala, Boca Raton, FL (US)

(73) Assignee: NVSVAV, LLC, Boca Raton, FL (US)

( * ) Notice: Subject to any disclaimer, the term of this patent is extended or adjusted under 35 U.S.C. 154(b) by 0 days.

(21) Appl. No.: 14/689,425

(22) Filed: Apr. 17, 2015

(65) Prior Publication Data

US 2015/0302741 A1 Oct. 22, 2015

Related U.S. Application Data

(60) Provisional application No. 61/980,987, filed on Apr. 17, 2014.

(51) Int. Cl.

| | |
|---|---|
| ***G08G 1/00*** | (2006.01) |
| ***G08G 1/005*** | (2006.01) |
| ***G08G 1/095*** | (2006.01) |

(52) U.S. Cl.

CPC ..... *G08G 1/005* (2013.01); *G08G 1/095* (2013.01)

(58) Field of Classification Search

CPC .... G08G 1/005; G08G 1/0116; G08G 1/0145; G08G 1/095; G08G 1/0965; G08G 1/096741; G08G 1/096783

USPC ..... 340/916, 928, 905, 929

See application file for complete search history.

(56) References Cited

U.S. PATENT DOCUMENTS

| | | | | |
|---|---|---|---|---|
| 5,150,116 | A | 9/1992 | West | |
| 7,466,241 | B2 * | 12/2008 | Lyle | G06Q 30/0251 340/691.6 |
| 8,232,896 | B2 * | 7/2012 | Keller | G09F 27/00 340/10.4 |
| 2005/0280552 | A1 * | 12/2005 | DiPiazza | G08G 1/052 340/905 |
| 2006/0176192 | A1 * | 8/2006 | Noriega | G08G 1/095 340/907 |
| 2009/0303036 | A1 * | 12/2009 | Sahuguet | G06F 17/30047 340/539.13 |
| 2011/0133952 | A1 * | 6/2011 | McNamara | G08G 1/096716 340/905 |
| 2013/0022245 | A1 * | 1/2013 | Sivertsen | G08G 1/07 382/104 |
| 2014/0046509 | A1 * | 2/2014 | Otake | G08G 1/095 701/2 |
| 2014/0118553 | A1 * | 5/2014 | Diba | G08G 1/087 348/149 |
| 2015/0154860 | A1 * | 6/2015 | Holzwanger | G08G 1/005 340/944 |

* cited by examiner

*Primary Examiner* — Omar Casillashernandez
(74) *Attorney, Agent, or Firm* — McHale & Slavin, P.A.

(57) ABSTRACT

The present invention provides a system and method for displaying information at a traffic signal. The system includes a computer system coupled to the computer system controlling the traffic signal to time the display of information on a separate monitor located adjacent a traffic signal. The displayed information can include such things as advertising, notices of public interest such as an Amber alert, and/or upcoming traffic conditions. The timing of the displayed information is such as to not interfere with attention needed for a person to navigate through the traffic signal.

20 Claims, 5 Drawing Sheets

TRAFFIC SIGNAL DISPLAY AND METHOD

PRIORITY CLAIM

In accordance with 37 C.F.R. 1.76, a claim of priority is included in an Application Data Sheet filed concurrently herewith. Accordingly, the present invention claims priority to U.S. Provisional Application No. 61/980,987, entitled "Traffic Signal Display and Method", filed Apr. 17, 2014, the contents of which are incorporated herein in their entirety.

FIELD OF THE INVENTION

A device and method for displaying a public safety message, an advertisement, or information at a traffic control signal.

BACKGROUND OF THE INVENTION

The operation of traffic control signals has become increasingly sophisticated. Traffic signals can include such things as traffic control lights, crosswalk lights and the like. Many traffic signals are now controlled by computers to time the operations of the various signals they provide such as green, yellow and red lights. The timing of such operations can be determined by the time of day or night, weather conditions, traffic conditions, overrides from emergency vehicles, pedestrians and the like. Such changes in operations can be highly variable and relatively instantaneous.

One example of traffic signal control is the crosswalk override. In this case, a pedestrian can activate a signal device, such as a pushbutton switch, to indicate to the traffic signal controller that they would like to cross the street. The computer, in accordance with preprogrammed instructions, can then turn a traffic light from green to red and turn on a crosswalk light indicating that the pedestrian can cross the street while the car traffic light is red. Such a system can be located at an intersection or an area of the road where there is no intersection but only a crosswalk.

Another form of traffic signal override can be located at an intersection that normally allows the major road to constantly have a green light. A minor road at the intersection can have a vehicle sensor that senses the presence of a vehicle at the intersection wishing to enter the major road. The minor road users encounter a normally red light which needs to change to green while the major road light needs to be changed to red. In accordance with preprogrammed instructions, the traffic signal, once it receives a signal from the minor road sensor, will change the lights so that the vehicle on the minor road can safely enter or cross the major road.

Traffic control thus results in people spending unproductive time waiting at traffic signals. It would be desirable to provide such people with useful information during a wait period. However, the presentation of such useful information needs to be timed appropriately to the operation of the traffic signal. This is desirable so that an entire message can be appropriately delivered to the people in a timely manner.

However, the elapsed time for displaying such information is a variable and occurs at different times of day. Thus, there is presented the problem of how to display information at a traffic signal in a useful manner.

SUMMARY OF THE INVENTION

Generally, the present invention provides a system and method for displaying information at a traffic signal. The system includes a computer system coupled to the computer system controlling the traffic signal to time the display of information on a separate monitor located adjacent a traffic signal. The displayed information can include such things as advertising, notices of public interest such as an Amber alert, and/or upcoming traffic conditions. The timing of the displayed information is such as to not interfere with attention needed for a person to navigate through the traffic signal.

It is therefore an objective of the present invention to provide a display device which can be used to effectively and timely deliver messages or information of interest to people and/or vehicles while waiting at traffic signals.

It is a further objective of the instant invention to provide a method which can be used to effectively and timely deliver messages or information of interest to people while they wait at traffic signals.

It is a further objective of the instant invention to provide a means to time the delivery of information at a traffic signal to effectively utilize the time available for delivery of one or more messages when the available time can vary in a preprogrammed manner or a random manner as controlled by a computer coupled to the traffic signal.

It is yet another objective of the instant invention to provide a system capable of selecting one or more information segments from a database of information segments to be displayed to fit within a variable time period.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
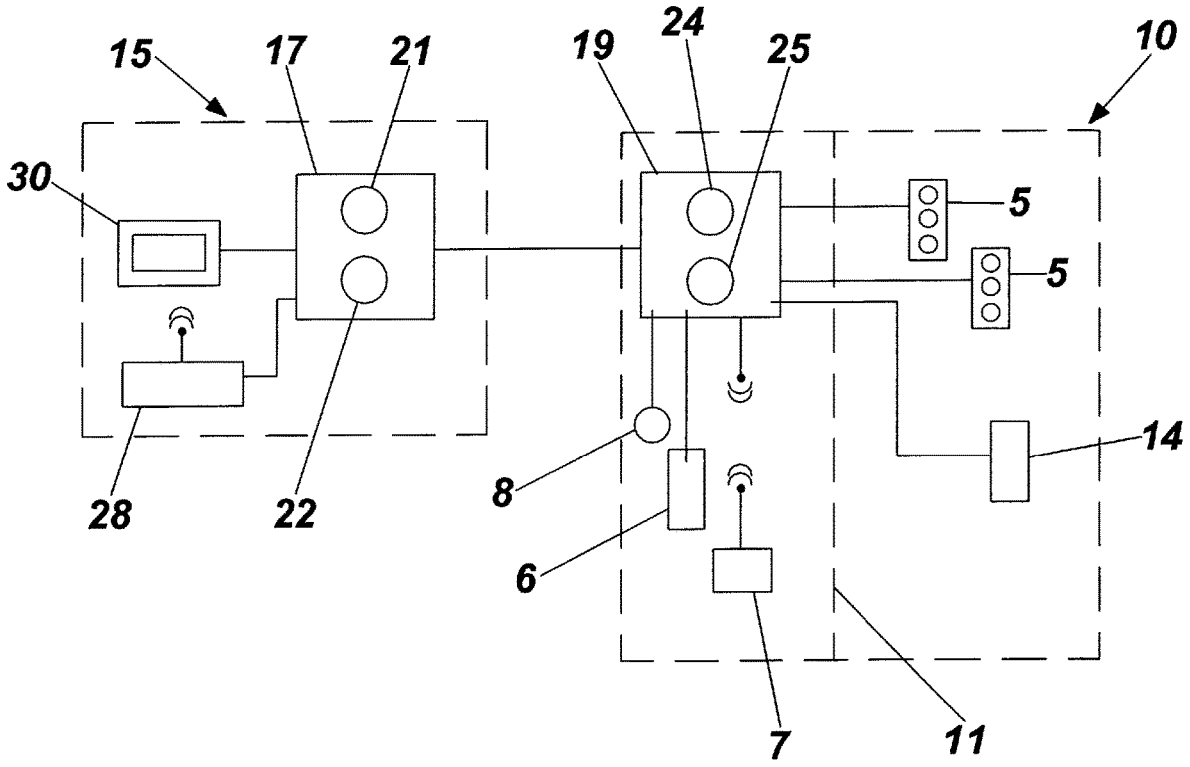
FIG. 1 is a schematic illustration of a system adapted for displaying information on a monitor at a traffic signal controlled by a computer system.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated or disclosed.

Figure 2:
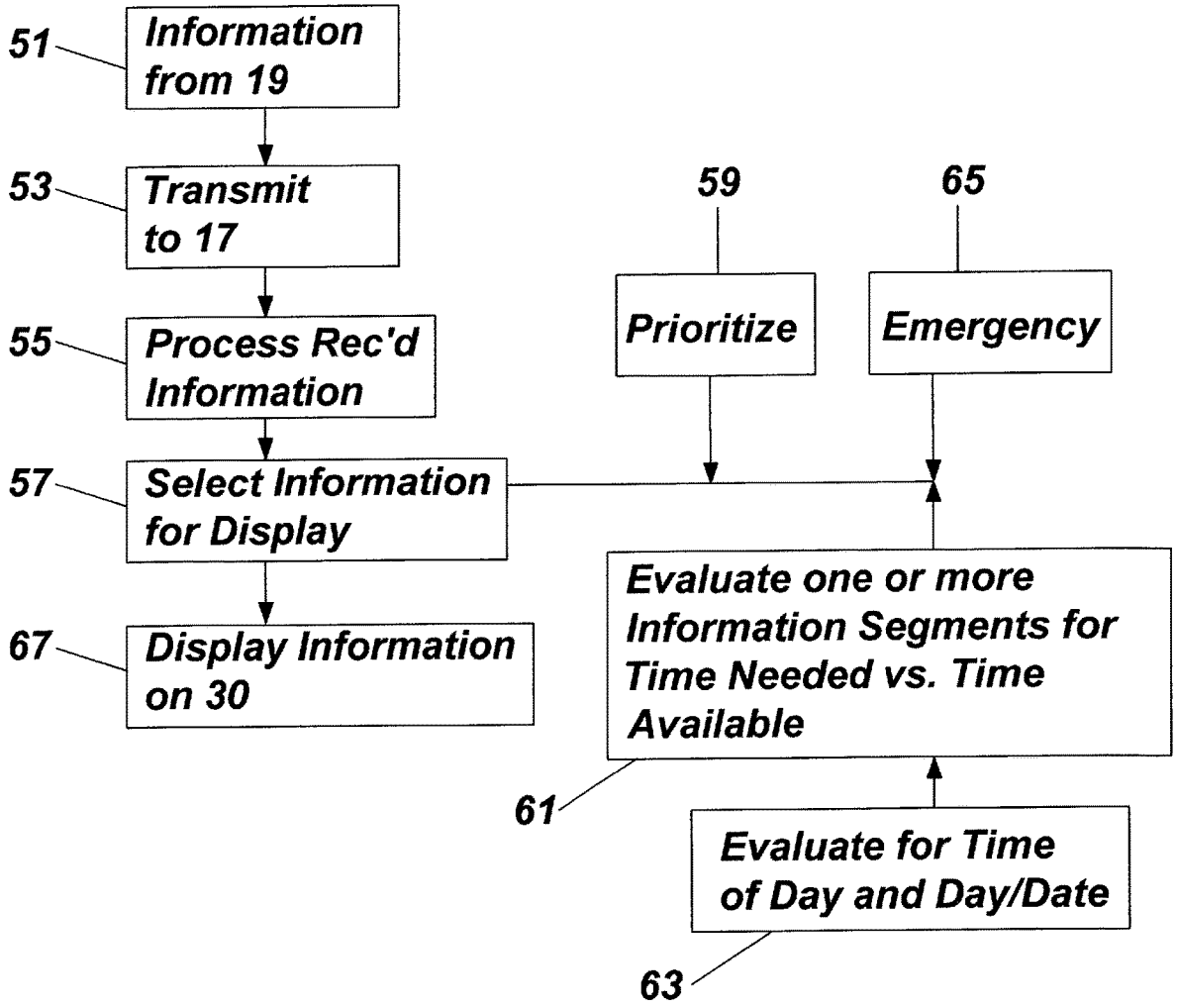
FIG. 2 is a flowchart showing schematically operation of a system for displaying information at a traffic signal.
Figure 3:
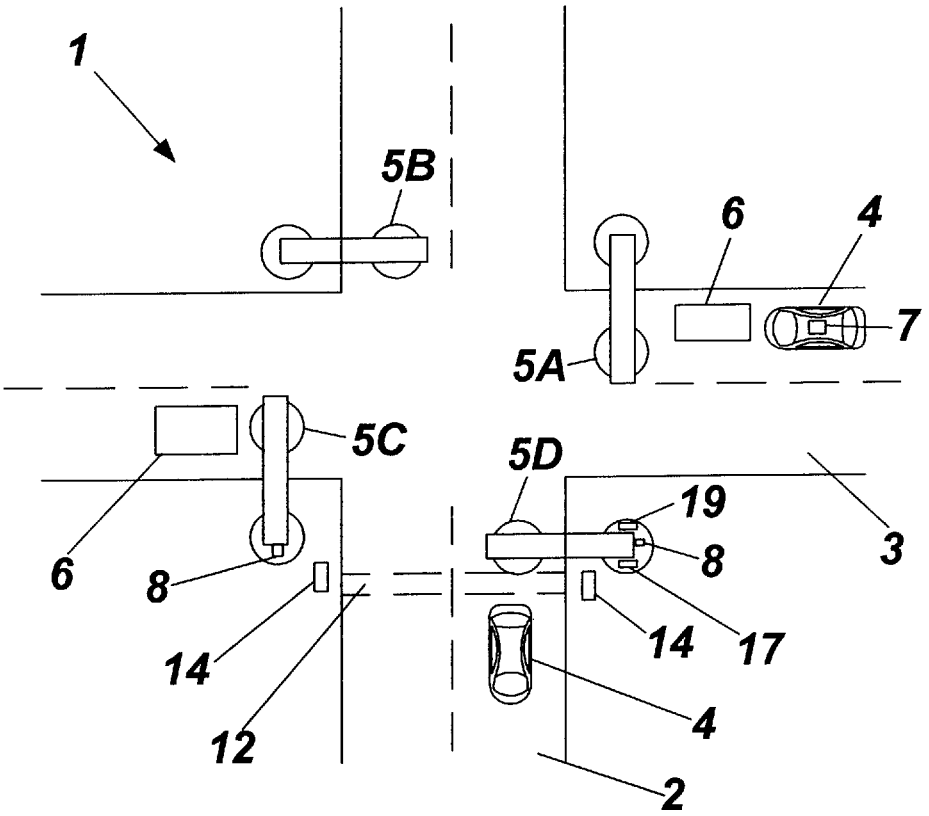
FIG. 3 is a schematic illustration of a traffic signal system at a road intersection.

Referring to FIGS. 1-3, an intersection, designated generally 1, is shown as a four-way intersection, i. e., two roads designated 2 and 3 that intersect. Each of the roads 2 and 3 is shown as being controlled by a signal device designated generally 5A-D. It is to be understood, however, that the invention can be used at any type of intersection controlled by any suitable signal device. Typically, a signal device 5A-D is stoplight operable to display lights of different colors, typically red, yellow and green, to indicate permissible movement of traffic. Turn control signals may also be provided as well as pedestrian control signals. Such traffic control systems are well known in the art. Such control systems can be computer-controlled to allow for changes in their operation to accommodate time of day, changes in traffic pattern, overrides by emergency vehicles from an input device such as a remote transmitter 7, traffic sensors 6 and pedestrians through operation of an override button 8 as known in the art. By way of example, during a so called rush hour, the vehicles 4 on the road 2 may be given more priority than vehicles 4 on cross road 3 through longer green lights provided for the users of road 2. Traffic sensors 6 can be utilized on a low usage road 3 to send a signal to a signal system 10 (FIG. 1) to indicate that there is cross traffic and allow its controller 11 to change the lights on signal devices 5B and 5D to red and the lights on signal devices 5A and 5C to green to allow vehicles 4 on road 3 to cross road 2. By way of further example, a pedestrian can activate the override button 8 when they wish to cross at the crosswalk 12. This provides a signal to the controller 11 which will then, when permitted by its programming, change the lights 5B and 5D to red allowing the pedestrian to then cross road 2. Crosswalk lights 14 can be provided at the intersection 1 which are operable to indicate to a pedestrian that it is permissible or not permissible to cross the road 2. Such traffic signals and their operation are well known in the art. While the invention is described in terms of roads for motorized vehicles, it can also be utilized for pedestrian and non-motorized vehicle roads (often referred to by other names such as paths and trails).

As shown, the signal system 10 includes various input devices such as the transmitter 7, traffic sensor 6 and pedestrian override button 8. The system 10 also includes output devices such as the signal devices 5A-D and a computer system 19 as described below. The controller 11, as shown, includes the computer system 19 and the various input devices 6-8.

The present invention can be an addition to an existing traffic signal control system 10. However, it is to be understood that traffic control systems 10 can have portions of the present invention integrated into the control system 10, allowing for the use of a single controller. The present invention will, for convenience, be described in terms of a separate control system coupled to an existing control system 10.

The display system, designated generally 15, includes a computer system 17 coupled to a computer system 19, FIG. 1. The computer system 17 is operable to function as a controller to control operation of the display system 15, while the computer system 19 controls operation of the traffic control system 10. The computer systems 17, 19 are programmed for effecting desired operation of the respective display system 15 and traffic signal devices 5A-D, 14. The traffic control system 10 is dominant to the display system 15 and provides information thereto by coupling of the computer systems 17 and 19. This coupling can be wireless or hard wired. The computer system 19 provides its operational information to the computer system 17 so that the computer system 17 can control operation of the display system 15. The computer system 17 includes both a digital processor 21 and a memory 22. The computer system 19 also includes both a digital processor 24 and memory 25. The computer system 19 is programmed to control operation of the output devices, such as the signal devices 5A-D, 14. The computer system 17 is programmed to receive information from the computer system 19, process the received information and effect operation of the display system 15 with its output device 30. A preferred output device 30 is a display monitor such as an LED screen or the like operable to visually display selected information. It should be noted that while the present disclosure discusses the display system as having a display monitor, the present invention also contemplates multiple monitors which may include screens which can only be viewed from predetermined angles and the like, to provide the information to persons or vehicles positioned in predetermined areas while preventing the viewing by other persons or vehicles.

The operation of the control system 10 can be such as to change the signals displayed by the signal devices 5A-D; for example, during heavy traffic periods which can be preprogrammed in the memory 25 for allowing traffic on road 2 to get longer green lights and more frequent green lights. This preprogrammed sequence can be adjusted by information received from the sensors 6, for traffic on the road 3. This adjustment can be made pursuant to preprogrammed instructions, e.g. algorithm, contained in the memory 25. A temporary adjustment can be made to the operating sequence by operation of the pedestrian override button 8 or an emergency vehicle sending a signal via transmitter 7, received by the computer system 19.

The computer system 19, through its programming, controls the duration of a red, green and/or yellow light of stoplights by providing control signals to various switches to turn the switch on or off. These control signals are communicated to the computer system 17 through the coupling of the two computer systems 17, 19. The control signals to the computer 17 alert it to the current operation of the signal devices 5A-D. This information is processed by the processor 21 in accordance with instructions programmed in the memory 22. The computer system 17 is programmed to process the received control signal information and time various output operations of the display system 15.

The display system 15 includes the output device 30 which receives information from the computer system 17 that can be displayed as preprogrammed. Information for displaying is preferably stored in the memory 22. Such information can include highway conditions that can be received from various sensors similar to the aforementioned sensors 6. These sensors can provide weather data, road conditions, traffic data and the like. Information for display can also include such things as Amber alerts and adverse traffic conditions which can be transmitted to the computer system 17 wirelessly or by a hard wire, and can be given a priority for display as preprogrammed. The information stored for display or received for display will have a time duration. The computer system 17 can be programmed to select various information segments, e.g., various advertisements, public safety messages, information etc., either individually or in combination of separate information files, and through programming can select appropriate information for display by time of day and duration for display to fill the time period available for display, say for example the length of time the red light will be on, which would allow a person stopped at the intersection to view one or more complete information segments. For example, a breakfast ad can be shown during morning hours while dinner ads can be shown during afternoon and evening hours, and could be followed by a car ad segment which is not time of day sensitive. A tabulation of the information displayed can be accumulated in a database in the memory 22 for accounting and billing purposes for information displays that can be charged to an entity for the display. In at least one embodiment, the information regarding information displayed may be transferred directly to a command center for billing the customer for the ad displayed. The system can also be utilized to warn viewers when an emergency vehicle is approaching should the emergency vehicle provide a signal from the transmitter 7 indicating the necessity to stop traffic and allow safe entry into the intersection. The programmed instructions can determine what information segments are shown and when, avoid conflicting information being displayed in one display period, for example, two sequential competing restaurant ads.

The computer system 17 can be programmed to cease operations or change its operations in the event of a malfunction of the control system 10. For example, if the controller 11 is calling for a flashing red light, information displayed on the monitor 30 can be terminated or different types of information can be selected from information segments in the memory 22 that are more appropriate for short stays at the intersection. Information stored in memory 22 can be changed from time to time by coupling of the computer 17 to another memory, either by wire or wireless and can be done from a remote location.

A preferred method of operation sequence is illustrated in FIG. 2. Operating information 51 for the traffic signal system 10 is transmitted to the display system 15. This information 51 can include time of day, day of week, date, and traffic signal duration and selection (e.g., red, green, yellow, flashing, etc.). The operating information 51 is transmitted to the computer 17 at 53. It is to be understood that some of the just mentioned information can already be known by the computer 17, e.g., time of day, day of week and date. The computer system 17 processes the information at 55 and selects information segments, at 57, appropriate for display, given programmed criteria, to effectively utilize the available time for displaying the selected information on the output device 30. Such information can be displayed on the output device 30 during a red light period. Selection of the information segment for display can include prioritization criteria 59, including time needed to complete the segment, or segments, as compared to time available 61, and other criteria such as time of day, day of week, date, etc. 63. The computer system 17 can also give priority to emergency information 65. The selected information segment or segments is then displayed at 67. In the event of an emergency prioritization, the computer 17 can select to display information during more than just the red light period, so that the emergency message is visible to all passing motorists, pedestrians, bicyclists, etc. Prioritization of non-emergency segments can be based on agreements with companies based on various times of day which correlate to different volumes of traffic.

Figure 4:
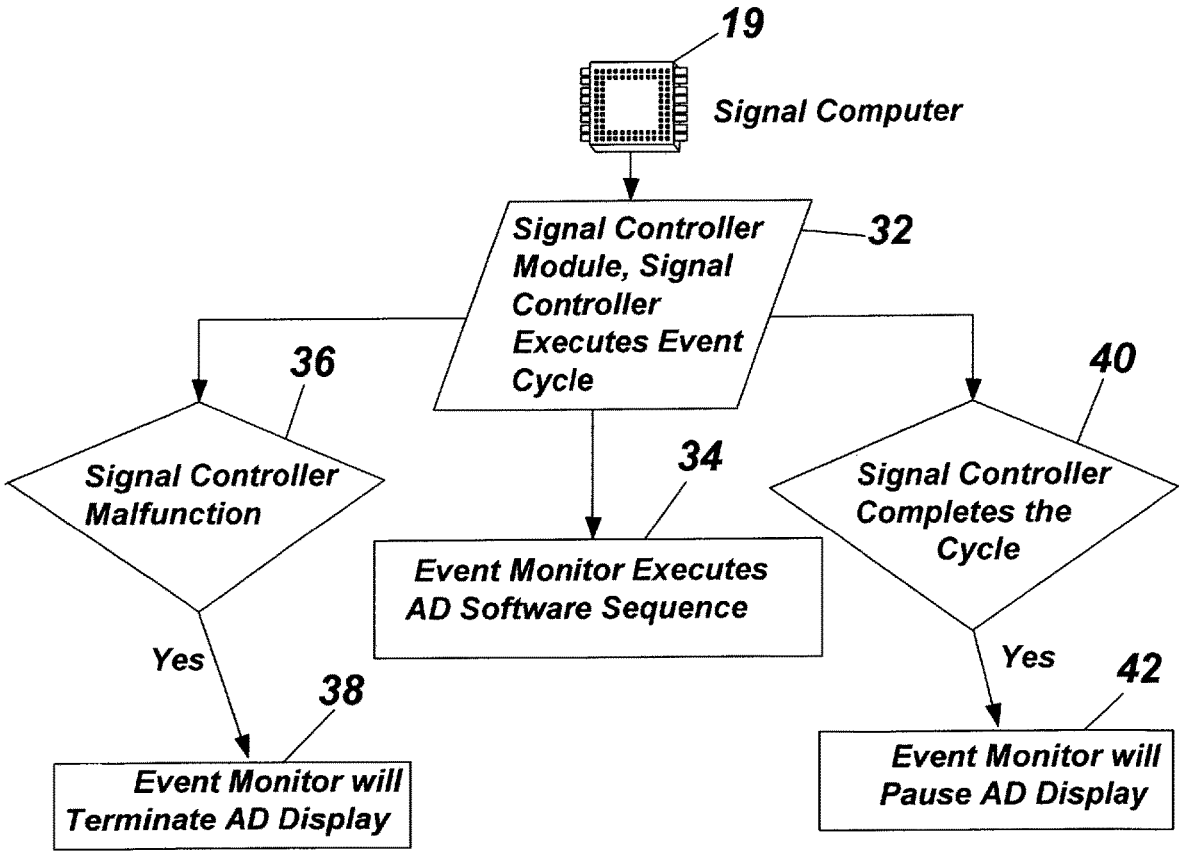
FIG. 4 is a flowchart illustrating the operation of the present system and method for displaying information at a traffic signal.

FIG. 4 shows the underlying operation leading to the operation sequence illustrated in FIG. 2. Within the traffic system computer system 19, the signal controller executes an event cycle at 32. During operation, the controller causes the output device 30 to display the executed ad segment at 34. While this occurs, the controller checks for a signal malfunction 36. If a signal malfunction is detected, the controller terminates the ad segment being displayed at 38. If no signal malfunction is detected, and until one is detected, the controller will execute the software sequence to display the ad segment at 34. While the ad segment is processing, the controller keeps track of the traffic signal cycle. If the signal cycle is pre-determined, where the red-light period of time is known as a fixed period upon initiation of the red-light, then display output can include a timer showing how much time is left for the red-light period. When the signal controller completes the red-light cycle at 40, the controller will pause the ad software sequence at 42, to be resumed upon the next red-light cycle. Alternatively, two or more signals may be connected to form a network whereby the ad sequence may be continued to the next signal light along the vehicles path. In this embodiment, the networked signal lights may also include internet transmitters for the creation of an internet network between the signals.

In one embodiment, the display system 15 can include a sensor 28 for recognition of vehicles or cellular telephones. Sensor 28 can be based on RFID technology, GPS, Bluetooth, Wi-Fi, or similar known technologies which can be incorporated into the output device 30, or other structure within the display system 15. Alternatively, the sensor can be positioned within the existing signal pole, as well as within the pedestrian override button 8, so that pedestrian traffic is also identified.

By connecting with a vehicle computer, or a cellular phone, the display system 15 is able to identify and catalog the amount of viewers present during the display of each ad segment. Incorporating a secondary software application, the display system 15 can link with the vehicle computer, cellular phone or radio frequency identification (RFID) chip or sticker and provide supplemental advertisements or coupons related to the ad segments displayed to the viewer, or which relate to businesses in the vicinity.

Further uses of sensor 28 can be to help locate specific vehicles or cellular phones, such as during Amber alerts, or similar situations. Law enforcement would also benefit from being able to quickly and efficiently track or find a person or vehicle. The system can also be used to display traffic control signs on a portion of the screen in the event that the local police force needs to control traffic for events or other high traffic issues.

A game system can also be tied into the present invention. For example, with the game system, a treasure-hunt type game can be implemented where a driver can collect points, coupons or the like, by passing through specified intersections. In some games, clues may be provided as the communication capable vehicle or cell phone passes through an intersection directing them to the next intersection of the game.

Figure 5:
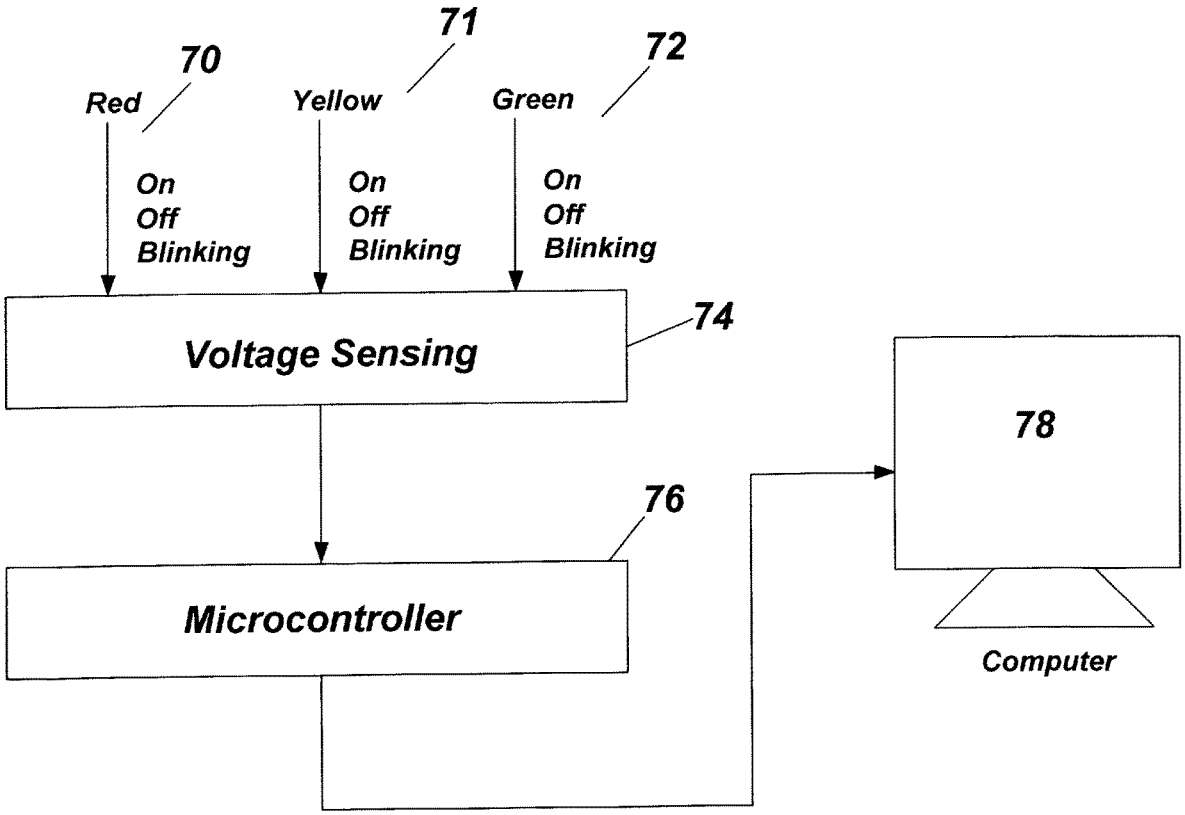
FIG. 5 is a flowchart illustrating an alternate embodiment of a system for displaying information at a traffic signal incorporating voltage sensor(s) on the traffic lights.

In an alternate embodiment, illustrated in FIG. 5, a voltage sensing unit is employed when it is not possible or feasible to directly connect the display system computer to the traffic signal computer. This embodiment then needs to connect directly to the traffic signal lights. The voltage sensing unit senses the voltage being employed by the individual red, yellow, and green lights of the traffic signal to determine at 74 whether: the red light is on, off, or blinking 70; the yellow light is on, off, or blinking 71; and the green light is on, off, or blinking 72. Based on the activation of the lights, the voltage sensing unit transmits the signal to the microcontroller at 76 which triggers the computer at 78 to execute the appropriate software segment. With this method, the display computer will not be able to display the remaining time of the red light cycle, or time the ad segment or segments to the amount of time of the red light cycle; the computer can execute the ad segment during a red light cycle and pause the program when the voltage sensing unit senses that the red light is off. The green and yellow light sensors help provide the complete picture of what is occurring at the intersection, so that the display computer can select the appropriate executable ad sequence. In at least one embodiment, the voltage sensing unit is added to one of the other embodiments described herein to provide a safety factor whereby the display system is shut down when one or more of the signals lights are not functioning properly. This construction eliminates confusion to drivers who may see an advertisement but no traffic signal light.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A system for displaying information on a display device at a traffic signal, said system comprising:

a traffic control system, said traffic control system including at least one traffic signal operable to provide indicators of acceptable and unacceptable movement of traffic on a road in proximity to the traffic signal, said traffic control system including a first computer system including a first memory device and a first digital processor coupled to the first memory device, said first computer system being electrically coupled to said traffic signal and operable to control operation of said at least one traffic signal, said first computer system monitoring movement of said traffic with at least one traffic sensor embedded into said road, said first computer system developing a traffic signal timing sequence following an operating instruction algorithm for timing the light operation of said traffic signal based upon said traffic movement interaction with said at least one traffic sensor embedded in said road, said traffic signal timing sequence transferred electronically to a second computer in a manner that causes said second computer system to select information segments that fit within said traffic signal timing sequence so that entire information segments are displayed on at least one display monitor, said traffic control system in electrical communication with a display system, said display system including said at least one display monitor associated with each said at least one said traffic signal to be viewable simultaneously, said display system including said second computer system in electrical communication with said at least one display monitor, said second computer system including a second memory device and a second digital processor electrically coupled to said second memory device, said second computer system being electrically coupled to said first computer system, said first computer transferring control signals regarding light operation and light timing in real time to said second computer, allowing said second computer to control operation of said at least one display monitor in accordance with said light timing of said traffic signal and in accordance with said operating instruction algorithm programmed in said first computer system for display of electronic information on said at least one display monitor.

2. The system for displaying information on a display device at a traffic signal of claim 1 wherein said first computer system changes said operating instruction algorithm for operation of indicator lights within said traffic signal to accommodate changes in a traffic pattern and whereby said second computer of said display system modifies the display of said electronic information in accordance with said operating instruction algorithm changes in real time.

3. The system for displaying information on a display device at a traffic signal of claim 2 wherein said first computer system monitors said traffic pattern with at least one traffic sensor.

4. The system for displaying information on a display device at a traffic signal of claim 2 wherein said traffic signal includes a red display light, a yellow display light and a green display light, said selected electronic information displayed on said at least one display monitor only while said red display light is illuminated.

5. The system for displaying information on a display device at a traffic signal of claim 4 wherein said electronic information displayed on said at least one display monitor includes a countdown timer, said countdown time displayed provided by electrical communication with said first computer system.

6. The system for displaying information on a display device at a traffic signal of claim 5 wherein said electronic information displayed on said at least one display monitor is selected by said second computer system to fill said count time.

7. The system for displaying information on a display device at a traffic signal of claim 1 wherein said electronic information displayed on said at least one display monitor is provided to said second computer system wirelessly for storage upon said second memory device.

8. The system for displaying information on a display device at a traffic signal of claim 1 wherein said electronic information displayed on said at least one display monitor includes emergency information, said emergency information prioritized over other electronic information displayed upon said at least one display monitor.

9. The system for displaying information on a display device at a traffic signal of claim 8 wherein said emergency information includes Amber alerts.

10. The system for displaying information on a display device at a traffic signal of claim 8 wherein said emergency information includes emergency vehicle approaching alerts, said emergency vehicles including a device for wirelessly communicating with said second computer system.

11. The system for displaying information on a display device at a traffic signal of claim 1 wherein said second computer system includes at least one sensor for detecting and communicating wirelessly with vehicles equipped with wireless data transfer capability, whereby data can be transferred bi-directionally between said second computer system and said vehicles.

12. A method of displaying information on a display device at a traffic signal in accordance with operation of the traffic signal, the method including:

operating a traffic signal to provide indicators of acceptable and unacceptable movements of traffic on a road in proximity to said traffic signal, said traffic signal operation being in accordance with traffic light operation signals from a first computer system including a first memory device and a first digital processor coupled to said first memory device, said first computer system monitoring movement of said traffic with at least one traffic sensor embedded into said road, said first computer system developing a traffic signal timing sequence following an operating instruction algorithm for timing the light operation of said traffic signal based upon said traffic movement interaction with said at least one traffic sensor embedded into said road, said first computer system being coupled to said traffic signal and operable to control operation of said traffic signal in accordance with said traffic signal timing sequence;

transferring said traffic light operation signals from said first computer system to a second computer system electrically in real time;

transferring said traffic signal timing sequence electrically to said second computer in a manner that causes said second computer system to select information segments that fit within said traffic signal timing sequence so that entire information segments are displayed on at least one display monitor; and operating a display monitor adjacent said traffic signal, said operation of said display monitor being in accordance with said traffic light operation signals from said first computer system as transferred to said second computer system including a second memory device and a second digital processor coupled to said second memory device, said second computer system being electrically coupled to said display monitor and said first computer system for real time transfer of said traffic light operation signals to said second computer and operable to control operation of said display monitor in accordance with said traffic signal timing sequence for display of entire information segments.

13. The system for displaying information on a display device at a traffic signal of claim 12 wherein said second computer system includes at least one sensor for detecting and communicating wirelessly with cell phones equipped with wireless data transfer capability, whereby data can be transferred bi-directionally between said second computer system and said cellphones within a predetermined range.

14. The system for displaying information on a display device at a traffic signal of claim 13 wherein said data transferred to said cell phones includes coupons relating to electronic information displayed on said at least one display monitor.

15. The system for displaying information on a display device at a traffic signal of claim 13 wherein said data transferred to said cell phones includes a game system whereby points are collected for passing through intersections including said system for displaying information on a traffic device.

16. A system for displaying information on a display device at a traffic signal, said system including:

a traffic signal operable to provide indicators of acceptable and unacceptable movement of traffic on a road in proximity to said traffic signal;

a display monitor adjacent said traffic signal;

a sensor system embedded into the roadway for monitoring presence and movement of said traffic;

a computer system including a memory device and a digital processor electrically coupled to said memory device, said computer system being electrically coupled to said traffic signal and said sensor system, said computer system monitoring movement of said traffic with said at least one traffic sensor embedded into said road, said first computer system developing a traffic signal timing sequence following an operating instruction algorithm for timing the light operation of said traffic signal based upon said traffic movement interaction with said at least one sensor embedded into said road, said computer system being coupled to said display monitor and operable to control operation of said traffic signal in accordance with said traffic signal timing sequence, and display selected information on said display monitor so that complete information segments are viewable relative to operation of said traffic signal.

17. The system for displaying information on a display device at a traffic signal of claim 16 wherein said computer system changes said operating instruction algorithm for operation of said traffic signal to accommodate changes in a traffic pattern and whereby said display of said selected information on said monitor changes in proportion to said operation of said traffic signal.

18. The system for displaying information on a display device at a traffic signal of claim 16 wherein said selected information on said monitor includes a countdown timer indicating the time until said indicator of said traffic signal changes to a different indicator.

19. The system for displaying information on a display device at a traffic signal of claim 16 wherein said computer system includes at least one sensor for detecting and communicating wirelessly with vehicles equipped with wireless data transfer capability, whereby data can be transferred bi-directionally between said computer system and said vehicles.

20. A system for displaying information on a display device at a traffic signal, said system comprising:

a traffic control system, said traffic control system including at least one traffic signal operable to provide indicators of acceptable and unacceptable movement of traffic on a road in proximity to the traffic signal, said traffic control system including a first computer system including a first memory device and a first digital processor coupled to the first memory device, said first computer system being coupled to said traffic signal and operable to control operation of said at least one traffic signal in accordance with an operating instruction algorithm programmed in said first computer system, said traffic control system in electrical communication with a display system, said display system including at least one display monitor associated with each said at least one said traffic signal to be viewable simultaneously, said display system including a second computer system in electrical communication with said at least one display monitor, said second computer system including a second memory device and a second digital processor coupled to the second memory device, said second computer system being electrically coupled to said at least one display monitor and said first computer system to control operation of said at least one display monitor in accordance with operation of said traffic signal and in accordance with said operating instruction algorithm programmed in said first computer system for display of electronic information on said at least one display monitor at preselected times relative to operation of said traffic signal, wherein said second computer system includes at least one sensor for detecting and communicating wirelessly with cell phones equipped with wireless data transfer capability, whereby data can be transferred bi-directionally between said second computer system and said cell phones within a predetermined range, said data transferred to said cell phones including a game system whereby points are collected for passing through intersections including said system for displaying information on a traffic device.

* * * * *